United States Patent [19]

Lagerwerf et al.

[11] 4,182,407

[45] Jan. 8, 1980

[54] TUBE SHEET COMPRISING TWO INTERSPACED SHEET MEMBERS AND HEAT EXCHANGER COMPRISING AT LEAST ONE SUCH TUBE SHEET

[75] Inventors: Harry Lagerwerf, Rotterdam; Ronald Versluis, Alphen aan de Rijn, both of Netherlands

[73] Assignee: B. V. Neratoom, The Hague, Netherlands

[21] Appl. No.: 843,419

[22] Filed: Oct. 19, 1977

[30] Foreign Application Priority Data

Oct. 21, 1976 [NL] Netherlands ..... 7611676

[51] Int. Cl.[2] ..... F28F 9/04

[52] U.S. Cl. ..... 165/70; 165/134; 165/178; 285/93; 285/189

[58] Field of Search ..... 165/11, 70, 134, 178, 165/173; 29/157.4; 285/158, 93, 189, 286

[56] References Cited

U.S. PATENT DOCUMENTS

| | | | |
|---|---|---|---|
| 2,893,701 | 7/1959 | Bell | 165/11 |
| 3,610,329 | 10/1971 | Markert et al. | 165/134 |
| 3,945,431 | 3/1976 | Straub | 165/70 |

FOREIGN PATENT DOCUMENTS

| | | | |
|---|---|---|---|
| 728656 | 10/1942 | Fed. Rep. of Germany | 165/178 |
| 16944 | 10/1956 | Fed. Rep. of Germany | 165/11 |
| 1205121 | 11/1965 | Fed. Rep. of Germany | 165/134 |
| 485126 | 12/1917 | France | 165/70 |
| 650058 | 1/1929 | France | 165/70 |
| 105926 | 11/1917 | United Kingdom | 165/70 |
| 273605 | 7/1927 | United Kingdom | 165/70 |

*Primary Examiner*—Sheldon Jay Richter
*Attorney, Agent, or Firm*—Kenyon & Kenyon

[57] ABSTRACT

The present invention relates to a tube sheet comprising two parallel interspaced sheet members which are provided with aligned bores through which at least partly with interposition of sleeves, extend tubes or tube sections. The sleeves are provided with internal chambers which through openings in the sleeve wall communicate with the space between the sheet members. The tube plate according to the present invention is highly resistant to thermal shocks in that the internal chambers in the sleeves extend to beyond at least one of the sheet members, in particular the thermally heaviest loaded part.

5 Claims, 1 Drawing Figure

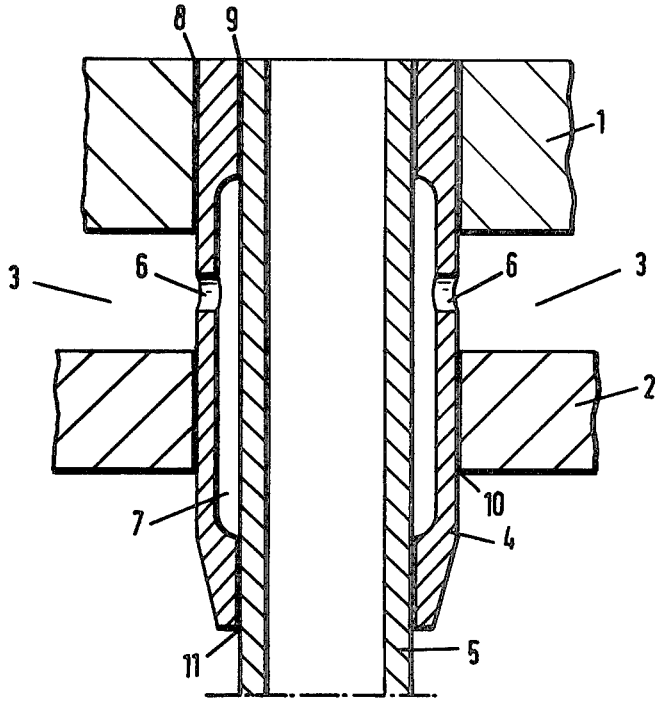
8
9
1
3
6
6
3
2
10
7
4
11
5

TUBE SHEET COMPRISING TWO INTERSPACED SHEET MEMBERS AND HEAT EXCHANGER COMPRISING AT LEAST ONE SUCH TUBE SHEET

The present invention relates to a tube sheet comprising two parallel, interspaced sheet members provided each time with aligned bores through which, at least partly through the inter position of sleeves, pipe or pipe sections extend, said sleeves being provided with internal chambers that, through openings in the sleeve wall, communicate with the space formed between the sheet members, as well as a heat exchanger comprising at least one such tube sheet.

Such a tube sheet is disclosed in French Pat. No. 650,058. This publication relates to a heat exchanger having tube sheets consisting of two parallel sheet members, there being present in the space between the sheet members a third fluid inert relative to the tube fluid and the shell fluid and having a higher pressure than the two other fluids. Adjacent the tube sheet opening there is disposed a sleeve provided with a chamber that communicates with the space disposed between the sheet members. The sleeve extends only over a portion of the tube sheet members and is bounded at one end via a synthetic filling by a projecting portion of the inner sheet member. At the other end of the sleeve there is disposed a closure member provided with an external thread by which there is obtained a sealing between the space beyond the tube sheet, the space within the tube sheet and the space between the sheet members.

Similar apparatuses are described in French Pat. No. 485,126 and British Pat. No. 273,605.

A drawback going with these apparatuses is their slight resistance to thermal shocks. Furthermore, the sealing of a closure member which is pressed against the sleeve through a thread and a synthetic filling leaves something to be desired. For specific applications to be mentioned yet, such a sealing is completely inacceptable.

Dutch patent application No. 72,17027discloses an apparatus provided with a tube sheet through which extend a plurality of parallel tubes. In said apparatus there is disposed within the tube sheet a diaphragm sheet parallel to the tube sheet, said diaphragm sheet having circular corrugations adjacent the openings disposed therein wherethrough the tubes extend. The tube sheet is provided with sleeves having an S-shaped profile which are disposed in the tube plate openings, connecting the tubes to the tube sheet.

German Auslegeschrift No. 1,205,121 discloses a similar apparatus which, however, instead of a diaphragm sheet having circular corrugations, comprises a spacer sheet. The sleeves of S-shaped profile in said apparatus are disposed within the bores in the spacer sheet through which the tubes extend, connecting the tubes to said spacer sheet.

The apparatuses disclosed in Dutch patent application No. 72,17027 and the German Auslegeschrift have a less robust construction in comparison with the above described apparatuses. Moreover, the manufacture is rather labour-intensive, inter alia in that the sheet members of the tube sheet have bores of different diameters.

It is the object of the present invention to provide for a tube sheet that is suitable for application in heat exchangers which are employed for heat transfer between fluids that strongly differ in temperature and/or pressure and/or show an explosive reaction when coming into contact with each other. In the same heat exchangers it is very important that the connections between the tubes of the tube system and the tube sheet meet with very high requirements. Examples of heat exchangers that have to comply with such high requirements are heat exchangers that are employed in petrochemical installations and heat exchangers utilized in the cooling system of sodium-cooled nuclear reactors. In the sodium-cooled nuclear reactors, the heat exchangers are employed for heat transfer between radioactive sodium and non-radioactive sodium and for heat exchange between sodium and water. In the latter case we speak of a steam generator. It will be clear that the sodium-cooling system of the nuclear reactors has to comply with the most stringent safety regulations, which as a result sets particularly high conditions to the construction of the tube sheets. This applies the more so since the pressure and temperature difference between the sodium and the steam is very high.

In particular such regulations imply that the tube sheets present in the heat exchangers are resistant to thermal shocks and the connections between the tubes and the tube sheets are optimally reliable and inspectable.

Consequently, it is an object of the present invention to provide for a tube sheet that meets with optimal safety requirements.

This object is achieved by a tube sheet comprising two parallel, interspaced sheet members, provided each time with aligned bores through which, at least partly with interposition of sleeves, tubes or tube sections extend, said sleeve being provided with internal chambers that, through openings in the sleeve wall, communicate with the space disposed between the sheet members, which is characterized according the invention in that the internal chambers extend to beyond at least one of the sheet members.

According to a preferred embodiment the sleeves incorporate tube sections. The connections between the sleeves and the sheet members and between the sleeves and the tube sections may then be effected with one heating treatment by means of a soldering material. In order to connect the pipe sections in a convenient and reliable manner, for instance via an internal-bore weld connection, it is furthermore advantageous that the tube section extend to beyond at least one of the tube outer sheet members, so as to avoid warping of the tube sheet as a result of heat development during the welding and to realize a better weld connection.

The invention will now be elucidated by way of Example, with reference to the accompanying drawing.

The drawing shows a partial cross section of a preferred embodiment of the tube sheet according to the invention, wherein reference numerals 1 and 2 indicate the sheet members, 3 the detection space, 4 a sleeve comprising a chamber, 5 a tube section disposed in the sleeve, 6 an opening in the wall of the sleeve and 7 a shell type space which, via openings 6, is in open communication with said detection space 3 between the sheet members 1 and 2.

Upon application in a steam generator, which is mounted to a cooling system of a sodium-cooled nuclear reactor, there is now present in the tube section 5 and above the heat member 1 water and/or steam, while underneath the heat member 2 there is present the sodium to be cooled, which likewise surrounds the parts of sleeve 4 and of tube section 5 projecting underneath the sheet member 2. Between sheet members 1 and 2, as well as in the shell type space 7 being in open communication with detection space 3 between the sheet members, there may be present air or an inert gas, which, if desired, can be maintained at increased pressure. In case of a leak of a connection 8–11 between the various parts, which in the present case are soldered joints, the sodium does not contact the water and/or steam. Furthermore it is easy to detect sodium or water and/or steam leaking through a joint via the shell type space 7 and/or detection space 3. This detection may be carried out in any suitable manner. Also, as a result of the presence of sleeve 4 and shell-like tube 7, there is obtained a proper resistance to any occurring thermal shocks in that the thermally heaviest loaded sheet member 2 is insulated by the shell-like space from the medium within the tube section 5.

We claim:

1. A header assembly for a heat exchanger including two spaced tube sheet members provided with at least one pair of aligned bores therethrough, a tube section extending through each pair of aligned bores, and a sleeve surrounding each tube section in the space between the sheet members, the sleeve being sealed to both sheet members and both ends of the sleeve being sealed to the exterior of said tube section, the internal surface of the sleeve being spaced from the external surface of the tube section to provide an internal chamber therebetween, and the sleeve wall having at least one opening intermediate the ends of the sleeve for communicating the internal chamber with the space between the sheet members, wherein the improvement comprises at least one end of said sleeve extending through the bore in the corresponding sheet member, said one end being sealingly attached to the exterior of said tube section at a location spaced from said sheet member on the side opposite the space between the sheet members, whereby said internal chamber extends beyond at least one of the sheet members to avoid warping during assembly.

2. A header assembly according to claim 1 wherein the aligned bores in the two sheet members are of equal diameters, said diameters being sized to fit the outside of the sleeve.

3. A header assembly according to claim 1 wherein the other end of the sleeve is sealingly attached to the exterior of the tube section adjacent to the corresponding other sheet member.

4. A header assembly according to claim 1 wherein the sheet member corresponding to the one end of the sleeve is adapted to face the interior of a heat exchanger to prevent thermal shock between the corresponding tube and said sheet member.

5. A heat exchanger comprising at least one header assembly according to claim 1.

* * * * *